United States Patent [19]

Hascal et al.

[11] Patent Number: 4,714,915

[45] Date of Patent: Dec. 22, 1987

[54] PORTABLE ELECTROSTATIC FIELD SAFETY MONITOR

[76] Inventors: Marcel Hascal, 1 Boldmere Crescent, Willowdale, Ontario, Canada, M2J 2R8; Sergio Lopez, 83 Milldock Drive, Scarborough, Ontario, Canada, M1C 4B8; Andrew Danielski, 180 Sherwood Street, Oshawa, Ontario, Canada, L1G 3L8; Adrian Mihai, 181 Robert Hicks Drive, Willowdale, Ontario, Canada, M2R 3R3

[21] Appl. No.: 912,976

[22] Filed: Sep. 29, 1986

[51] Int. Cl.[4] ..... G08B 21/00

[52] U.S. Cl. ..... 340/657; 324/457; 324/433

[58] Field of Search ..... 340/657, 658, 636; 324/133, 426, 457, 72, 458, 130; 320/48; 379/21

[56] References Cited

U.S. PATENT DOCUMENTS

| | | | |
|---|---|---|---|
| 3,309,690 | 5/1967 | Moffitt | 340/657 |
| 4,277,745 | 7/1981 | Deno | 324/457 |
| 4,520,318 | 5/1985 | Hascal et al. | 324/457 |

*Primary Examiner*—James L. Rowland
*Assistant Examiner*—Jill D. Jackson
*Attorney, Agent, or Firm*—Ridout & Maybee

[57] ABSTRACT

A portable monitoring system for detecting a radiated electrostatic field and producing an audible warning when the detected field exceeds a selected value is characterized by a switching device which can be used to reset the threshold warning level and which is not affected by the hand proximity effect. An alarm is sounded when a signal corresponding to the detected field exceeds a value which is stored. The stored value can be reset by a manually operated switching circuit including a delay device operable to delay the storage of a reference level corresponding to the intensity of the field currently detected.

12 Claims, 1 Drawing Figure

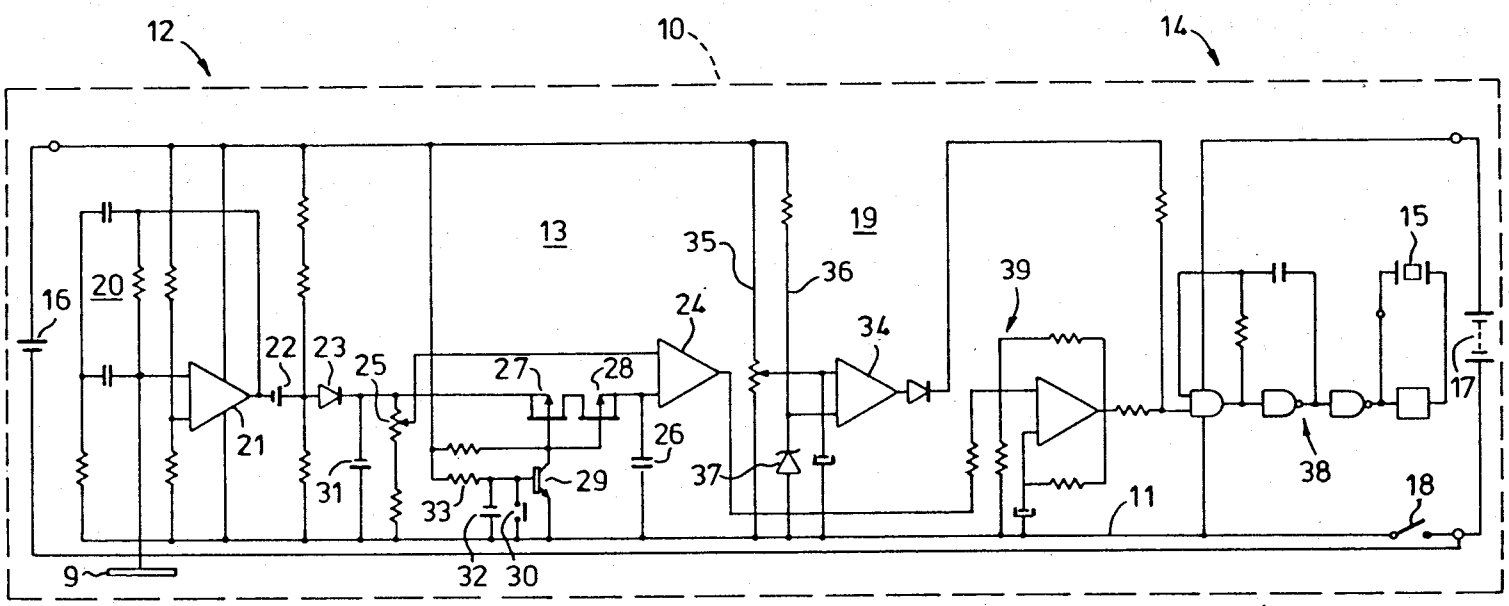
10
11
12
13
14
15
16
17
18
19
20
21
22
23
24
25
26
27
28
29
30
31
32
33
34
35
36
37
38
39
9

PORTABLE ELECTROSTATIC FIELD SAFETY MONITOR

This invention relates to a portable monitoring system for use by linemen and others who work in the vicinity of high voltage lines and equipment, and who for reasons of safety require to be warned of the proximity of lines and equipment to which they may be exposed. The present monitoring system is designed to produce an audible warning when the intensity of the electrostatic field detector thereby exceeds a selected predetermined value, this value being selected by the user so as to be within acceptable safety limits.

Numerous safety devices of this general type have been proposed. Such a device may be installed on a safety helmet to be worn by the user, as described for example in U.S. Pat. No. 3,309,690, issued Mar. 14, 1967 to Melville M. Moffitt. However, the safety devices of this general type which have been proposed so far are of limited value in practice and have not found favour. One of the main reasons for this is that the user cannot reliably set the device to respond to a selected predetermined field intensity level owing to distortion of the field by the hand proximity effect.

The present invention provides an improved monitoring system in which the above-mentioned difficulty is overcome.

A portable monitoring system according to the invention, for detecting a radiated electrostatic field and producing an audible warning when the intensity of the detected field exceeds a predetermined value, as when the user carrying the device moves too close to a high voltage conductor, basically comprises (a) detector circuit means for deriving a d.c. signal corresponding to the detected field intensity, (b) comparator means for comparing the d.c. signal with a selected reference level for producing an output signal when the d.c. signal level exceeds said reference level, the comparator means including a differential amplifier having a first input circuit connected to receive the d.c. signal and a second input circuit connected to receive a signal defining the reference level, and (c) audible alarm means responsive to said output signal for sounding a warning.

The system is characterized in this, that the monitoring system further comprises a storage device connected in said second input circuit of the differential amplifier for storing the signal defining said reference level, the storage device being interconnected with the output of the detector circuit means by a manually operable switching circuit, said switching circuit including a delay device and being operable to apply the d.c. signal to the storage device after a predetermined delay thereby to reset the reference level so as to correspond to the detected field intensity at a location selected by the user.

With this system the user can readily set or reset the reference level, that is, the threshold at which the alarm will respond, so as to correspond to a minimum safe distance from the high voltage conductor or equipment, the delay period permitting the user to withdraw his hand and so avoid spurious signals due to hand capacitance.

In order that the invention may be readily understood, one portable monitoring device in accordance therewith will now be described, by way example, with reference to the accompanying drawing.

The drawing shows a schematic circuit diagram of the monitoring system.

The electronic circuitry of the device is housed in an insulating housing 10, which may be mounted on the exterior of a safety helmet to be worn by the user, as described for example in U.S. Pat. No. 3,309,690. Alternatively, the device may be worn in any other convenient manner, or even incorporated with portable testing equipment.

The device is used to detect the electrostatic field surrounding an energized line which, in the present example, carries alternating current at power frequency, 60 Hz. For this purpose it employs the principle of electrostatic induction on parallel plates. One plate is the inductor plate, or antenna 9, while the other plate is constituted by a floating ground 11.

The electronic circuitry is of the type comprising, basically, detector circuit means 12, to the input of which the inductor plate 9 is connected, for deriving a d.c. signal corresponding to the intensity of the detected field; comparator means 13 for comparing the d.c. signal with a selected reference level for producing an output signal when the derived d.c. signal exceeds the reference level; and audible alarm means 14 constituted by an oscillator circuit which drives a transducer 15.

The detector circuit 12 and the comparator circuit 13 are connected in circuit with a first lithium battery 16 so as to be energized thereby. The alarm circuitry 14 is connected in circuit with a second lithium battery 17 so as to be energized thereby. A power switch 18 is connected in series with the batteries.

An important safety feature of the invention is that the voltage of the battery 16 is constantly monitored by a monitoring circuit 19 in such a way that, if the battery 16 fails or its supply voltage falls, the alarm circuit will be actuated and the user will thus be notified of the failure.

The detector circuit 12, to the input of which the antenna 9 is coupled, comprises an active filter consisting of an RC network 20 and an amplifier 21. The active filter is frequency selective so that the amplifier 21 will respond only to power frequency, thus minimizing interference from other sources of electrostatic field. The output of the amplifier 21 is coupled via a capacitor 22 to a rectifier circuit including a diode 23, by which the d.c. signal corresponding to the detected electrostatic field intensity is derived.

The comparator circuit 13 includes a differential amplifier 24. One input of the amplifier 24 is connected to receive the d.c. signal from the rectifier 23 by way of a potential divider 25 which serves to attenuate the signal applied to this input by a chosen amount. The other input of the amplifier 24 is connected to receive a signal which defines a reference level corresponding to the charge stored on a capacitor 26. In the event that the d.c. signal applied to the first input of the amplifier 24 exceeds the reference level, an output signal from the amplifier will energize the oscillator 14 as described hereinafter.

The second input of the amplifier 24, and the storage capacitor 26 connected to this input, are interconnected with the output of the rectifier 23 by a switching circuit which will now be described. The switching circuit consists essentially of an electronic switch comprising a pair of MOS switches 27, 28 connected back to back and a switching transistor 29 which can be turned off by a manually operable press button switch 30. When the user presses the switch 30, the transistor 29 is turned off, whereby the MOS switches are turned on. The voltage on capacitor 31 at the output of rectifier 23 is thus transferred to the capacitor 26. In this way the reference level corresponding to the voltage on the capacitor 26 can be reset.

A most important feature of the present invention is that the switching circuit described above includes a delay device whereby, following operation of the manual press button switch 30, the transfer of voltage from capacitor 31 to capacitor 26 continues after a predetermined time delay after the switch is released. A capacitor 32 and a series resistor 33 constitute an RC charging circuit, the capacitor 32 being connected across the switch 30. With this system, the user can set the device so as to sound an alarm at any distance from the relevant line voltage within the operating range of the device. Furthermore, the delaying electronic switching action when setting or resetting the reference level eliminates the hand proximity effect which hitherto has been a major problem with all monitoring devices of this type.

It will be noted that the potential divider 25 attenuates the d.c. signal applied to the first input of the amplifier 24 by a preset amount. Therefore, the alarm will only be actuated when the detected field exceeds the stored reference level by a percentage corresponding to this amount. Thus, the warning signal can be silenced simply by pressing the manual switch 30, i.e. the reset button, thus updating the stored reference level.

The battery-monitoring circuit 19 comprises a differential amplifier 34 and a pair of potential dividers 35, 36 connected across the battery 16. The first potential divider 35 derives a voltage proportional to the battery voltage and this is applied to an input of the amplifier 34. The second potential divider 36 includes a Zener diode 37 which derives a constant voltage which in turn is applied to the other input of the amplifier.

The potential divider 35 is preset so that there will be no output from the amplifier 34 so long as the battery voltage is maintained. If the battery voltage falls, a difference signal from the amplifier 34 will excite the oscillator circuitry 14 and so sound an alarm.

The oscillator circuitry 14 provides two modes of operation. It comprises a first audio oscillator 38 to which the difference signal from amplifier 34 is applied directly, thereby to sound an audible signal which is distinctive of battery failure. A second audio oscillator 39 having a lower operating frequency than the first is connected to receive the output signal from the comparator 24. The two audio oscillators are interconnected so that, in response to the output signal from the comparator 24, signifying that the detected electrostatic field exceeds a chosen threshold value, they will produce a frequency-modulated audible alarm signal distinctive of the field condition.

A monitoring device in accordance with the present invention has additional important advantages. With the circuitry described above the device can be made very small, the size typically being 5 cm.×8 cm.×2 cm., and very light, weighing about 70 grammes. The components are selected to achieve very low power consumption, whereby the device can operate for more than 1000 hours without change of battery.

What we claim is:

1. A portable monitoring system for detecting a radiated electrostatic field and producing an audible warning when the intensity of the detected field exceeds a selected predetermined value, comprising detector circuit means for deriving a d.c. signal corresponding to the detected field intensity, comparator means for comparing the d.c. signal with a selected reference level for producing an output signal when the d.c. signal level exceeds said reference level, the comparator means including a differential amplifier having a first input circuit connected to receive said d.c. signal and a second input circuit connected to receive a signal defining said reference level, and audible alarm means responsive to said output signal for sounding a warning, characterized in this, that the monitoring system further comprises a storage device connected in said second input circuit of the differential amplifier for storing the signal defining said reference level, the storage device being interconnected with the output of the detector circuit means by a manually operable switching circuit, said switching circuit including a delay device and being operable to apply the d.c. signal to the storage device after a predetermined delay thereby to reset the reference level so as to correspond to the detected field intensity at a location selected by the user.

2. A portable monitoring system according to claim 1, wherein the first input circuit of the differential amplifier includes a manually adjustable circuit means for attenuating the d.c. signal to be received by the differential amplifier through said first input circuit.

3. A portable monitoring system according to claim 2, wherein the manually operable switching circuit comprises an electronic switch having a normal OFF condition, and a normally open push button switch connected in circuit with the electronic switch, the push button switch being operable to effect switching of the electronic switch from the OFF to the ON condition immediately and to remain ON after a delay determined by the delay device after the push button switch is released.

4. A portable monitoring system according to claim 3, wherein the delay device is constituted by an RC charging circuit the capacitor of which is connected across the normally open push button switch.

5. A portable monitoring system according to claim 3, wherein the detector circuit means comprises antenna means, an active filter coupled to said antenna means for deriving therefrom an a.c. signal corresponding to a voltage induced at a selected frequency, and a rectifier for rectifying said a.c. signal thereby to derive said d.c. signal.

6. A portable monitoring system for detecting a radiated electrostatic field in the vicinity of a high voltage conductor energized at power line frequency, and for producing an audible warning when the intensity of the detected field exceeds a selected predetermined value, comprising:

an antenna sensitive to the electrostatic field, a first energizing circuit, detector circuit means connected in said first energizing circuit to be energized thereby, the detector circuit means being coupled to the antenna for deriving a d.c. signal corresponding to the detected field intensity, comparator means for comparing the d.c. signal with a selected reference level for producing an output signal when the d.c. signal exceeds said reference level, the comparator means including a differential amplifier connected in said first energizing circuit to be energized thereby, the differential amplifier having a first input circuit connected to receive said d.c. signal and a second input circuit connected to receive a signal defining said reference level, a second energizing circuit, audible alarm means connected in said second energizing circuit to be energized thereby, and circuit means interconnecting the audible alarm means with the output of said comparator means whereby to respond to said output signal for sounding a warning, said second input circuit of the differential amplifier including a storage device for storing the signal defining said reference level, the storage device being interconnected with the output of the detector circuit means by a manually operable switching circuit, said switching circuit including a delay device and being operable to apply the d.c. signal to the storage device after a predetermined delay thereby to reset the reference level so as to correspond to the detected field intensity at a location selected by the user.

7. A portable monitoring system according to claim 6, wherein the detector circuit includes an active filter tuned to the power line frequency, and rectifier means coupled to the output of the active filter for deriving said d.c. signal.

8. A portable monitoring system according to claim 7, wherein the first input circuit of the differential amplifier includes a manually adjustable attenuating circuit means for attenuating the d.c. signal to be received by the differential amplifier through said first input circuit.

9. A portable monitoring system according to claim 8, further comprising a battery-monitoring circuit means connected in said first energizing circuit to be energized thereby, said battery-monitoring circuit means comprising differential amplifier having a first input connected to receive a signal proportional to the voltage applied to said first energizing circuit and a second input connected to receive a signal derived from the first energizing circuit having a value defined by a Zener diode, whereby to produce a difference signal if the said voltage-proportional signal falls below the value defined by the Zener diode, said audible alarm means being connected to respond to said difference signal for sounding a warning in the event that the battery voltage falls below a predetermined value.

10. A portable monitoring system according to claim 9, wherein the audible alarm means comprises an electronic oscillator having a first input circuit connected to receive said output signal of the comparator means for exciting the oscillator in a first operating mode, and a second input circuit connected to receive said difference signal of the battery-monitoring circuit means for exciting the oscillator in a second operating mode, the alarm means further comprising transducer means coupled to the oscillator to be driven thereby for producing a distinctive audible signal in each of said operating modes.

11. A portable monitoring system according to claim 10, wherein the manually operable switching circuit comprises an electronic switch having a normal OFF condition, and a normally open push button switch connected in circuit with the electronic switch, the push button switch being operable to effect switching of the electronic switch from the OFF to the ON condition immediately and to remain ON after a delay determined by the delay device after the push button switch is released.

12. A portable monitoring system according to claim 11, wherein the delay device is constituted by an RC charging circuit the capacitor of which is connected across the normally open push button switch.

* * * * *